US011186987B2

(12) United States Patent
Simmons, Jr.

(10) Patent No.: US 11,186,987 B2
(45) Date of Patent: Nov. 30, 2021

(54) CONSTRUCTION BLOCK UNITS

(71) Applicant: B&B Flying Service, Inc., Buttonwillow, CA (US)

(72) Inventor: Felix J. Simmons, Jr., Toluca Lake, CA (US)

(73) Assignee: B&B Flying Service, Inc., Buttonwillow, CA (US)

( * ) Notice: Subject to any disclaimer, the term of this patent is extended or adjusted under 35 U.S.C. 154(b) by 0 days.

(21) Appl. No.: 17/037,295

(22) Filed: Sep. 29, 2020

(65) Prior Publication Data

US 2021/0238847 A1 Aug. 5, 2021

Related U.S. Application Data

(60) Provisional application No. 62/968,911, filed on Jan. 31, 2020.

(51) Int. Cl.
*E04B 2/18* (2006.01)
*E04B 2/26* (2006.01)
(Continued)

(52) U.S. Cl.
CPC ..... *E04B 2/18* (2013.01); *E04B 2/22* (2013.01); *E04B 2/26* (2013.01); *E04C 1/40* (2013.01);
(Continued)

(58) Field of Classification Search
CPC ..... E04B 1/02; E04B 1/08; E04B 1/12; E04B 1/18; E04B 1/20; E04B 1/22; E04B 1/26;
(Continued)

(56) References Cited

U.S. PATENT DOCUMENTS 3,180,059 A * 4/1965 Persak, Jr. ..... E04B 2/18 52/592.6
3,440,788 A * 4/1969 Merget ..... E04C 1/40 52/405.2
(Continued)

FOREIGN PATENT DOCUMENTS

BE 1025223 B1 * 12/2018 ..... E04B 2/08
FR 3014461 A1 * 6/2015 ..... E04B 2/18
(Continued)

*Primary Examiner* — Ryan D Kwiecinski
(74) *Attorney, Agent, or Firm* — SoCal IP Law Group LLP; Mark Andrew Goldstein; Nikki M. Dossman

(57) ABSTRACT

A construction block unit includes a construction block and a lid. The construction block includes a bottom plate having a shape, a sidewall extending perpendicularly from the bottom plate at an outer edge of the bottom plate to form a container configured to receive and contain a weight, and fasteners coupled to a top edge of the sidewall opposite the bottom plate. The lid has a congruent shape to the shape such that the lid is fastenable to the top edge of the side wall via the fasteners to enclose the container. An interlocking portion of the construction block is shaped to receive a corresponding interlocking portion of a second construction block by vertically sliding the corresponding interlocking portion into the interlocking portion, interlocking the construction block and the second construction block to prevent separation by a horizontal force.

20 Claims, 4 Drawing Sheets

(51) Int. Cl.
*E04C 1/40* (2006.01)
*E04B 2/22* (2006.01)
*E04B 2/02* (2006.01)

(52) U.S. Cl.
CPC ..... *E04B 2002/0226* (2013.01); *E04B 2002/0263* (2013.01)

(58) Field of Classification Search
CPC ..... E04B 2002/0226; E04B 2002/0204; E04B 2002/0206; E04B 2002/021; E04B 2002/0263; E04C 1/40
See application file for complete search history.

(56) References Cited

U.S. PATENT DOCUMENTS 4,688,365 A * 8/1987 McGuire ..... E04C 1/397 446/112
6,394,705 B1 * 5/2002 Lefebvre ..... E02B 3/108 405/262
7,704,011 B2 * 4/2010 Marshall ..... E02D 27/02 404/29
8,382,398 B2 * 2/2013 Stauffacher ..... E02B 3/108 405/111
D686,756 S * 7/2013 Nanayakkara ..... D25/113
8,910,438 B1 * 12/2014 Shiban ..... E04B 1/92 52/284
10,106,980 B2 * 10/2018 Martinez ..... E04B 2/08
2006/0000179 A1 * 1/2006 Albert ..... E04B 2/16 52/606
2014/0106108 A1 * 4/2014 Lin ..... A63H 33/082 428/58
2018/0347188 A1 * 12/2018 Parks ..... E04B 2/26
2021/0238846 A1 * 8/2021 Zhang ..... E04B 2/18

FOREIGN PATENT DOCUMENTS

GB 2004578 A * 4/1979 ..... E04B 2/18
GB 2443630 A * 5/2008 ..... E04B 2/18
WO WO-2006129115 A1 * 12/2006 ..... E04B 1/08
WO WO-2012143585 A1 * 10/2012 ..... E04B 2/24

* cited by examiner

CONSTRUCTION BLOCK UNITS

RELATED APPLICATION INFORMATION

This patent claims priority from provisional patent application No. 62/968,911, entitled CONSTRUCTION BLOCKS, filed on Jan. 31, 2020, the entire content of which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to construction blocks, and, more particularly, to interlocking construction blocks.

Description of the Related Art

Habitable structures, such as those used for houses, businesses, and storage, need to be constructed of study and durable materials that can withstand various weather conditions over time to usefully protect the people and things inside the structure. Further, the materials should also be sturdy enough to deter or prevent unwanted intruders, whether animal or human. These materials are also ideally resistant to mold, fungus, water damage, insect damage, and other types of decay. The materials must also not make the environment inside the structure toxic to the inhabitants, for example, by emitting poisonous vapors or particles into the air inside the structure.

Some traditional construction materials for building structures, such as concrete, cinder blocks, metal, and bricks, can be expensive, heavy to transport, and unwieldy to manipulate during the construction process. Further, these traditional construction materials typically require additional bonding material, such as mortar, to bond the construction materials in a useful way. The bonding material can also be expensive, heavy, and require laborious mixing with water.

Other types of construction materials, such as wood, stucco, and vinyl, require time-consuming installation by a team of skilled workers with special tools, which can be expensive and slow the construction process. These materials can also be costly.

There is a great need for safe and affordable structures due to quickly rising housing costs and increasing numbers of homeless people. Improved construction materials that fulfill the sturdiness requirements of habitable structures, yet are inexpensive and easy to transport and manipulate, are desirable to help provide this suitable and affordable housing.

Throughout this description, elements appearing in figures are assigned three-digit or four-digit reference designators, where the two least significant digits are specific to the element and the one or two most significant digit is the figure number where the element is first introduced. An element that is not described in conjunction with a figure may be presumed to have the same characteristics and function as a previously described element having the same reference designator.

DETAILED DESCRIPTION

Description of Apparatus

Construction block units disclosed herein are an improved material for constructing structures. Each construction block has structural elements to provide a light-weight, rigid, and stable building material. These construction blocks can be inexpensively manufactured and are lightweight to transport and manipulate. Further, the construction blocks can be coupled together without the need for additional materials such as mortar or cement. The construction blocks can include various sizes and shapes, and can be assembled together in various configurations to construct desired structures. Once coupled, the hollow interiors of the construction blocks can be filled with a weight, such as sand or water, to create sturdy and durable structure walls for various uses, such as for homes and businesses.

Figure 1:
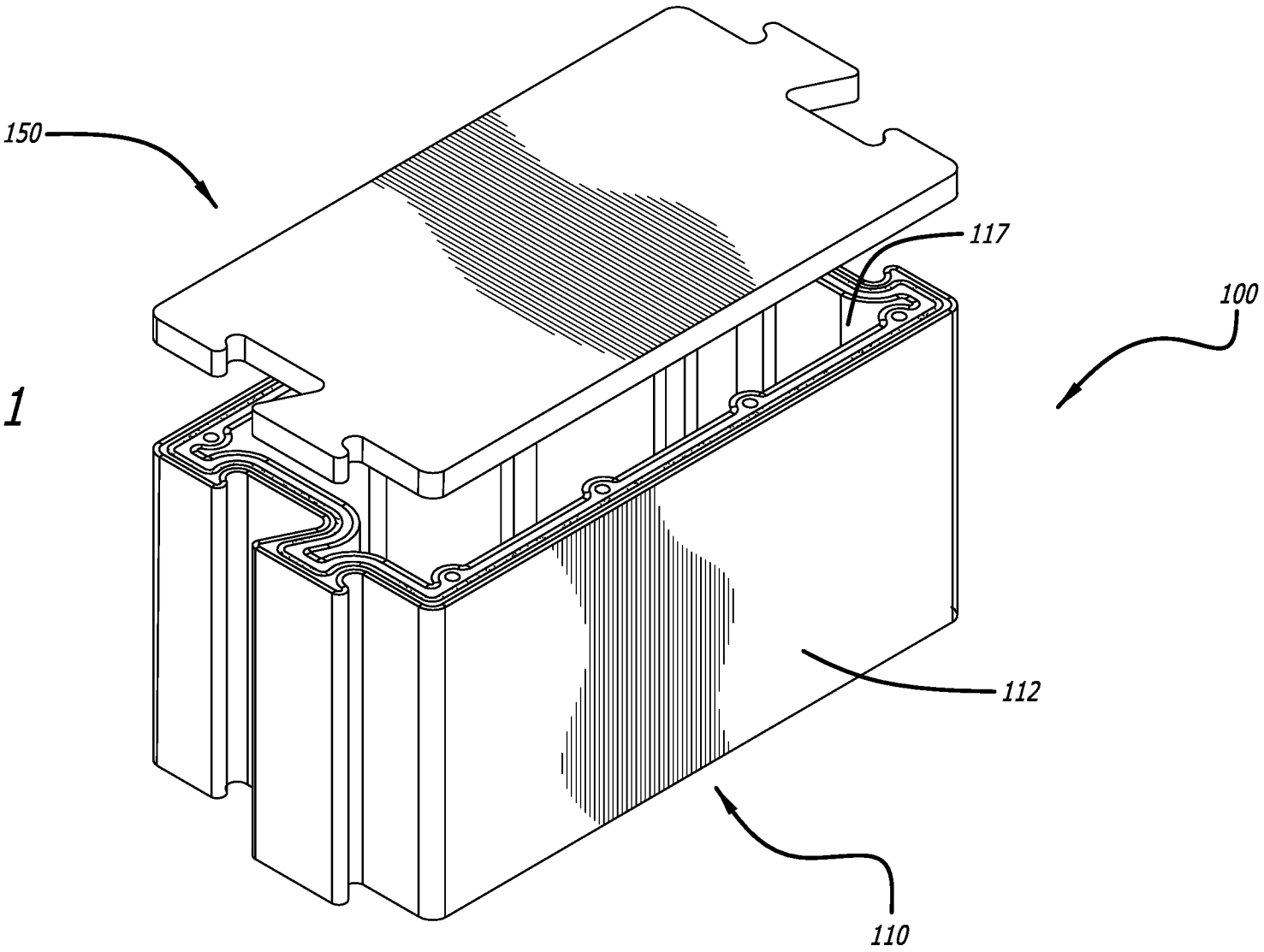
FIG. 1 shows a perspective view of a construction block unit including a construction block and a lid.
Figure 2:
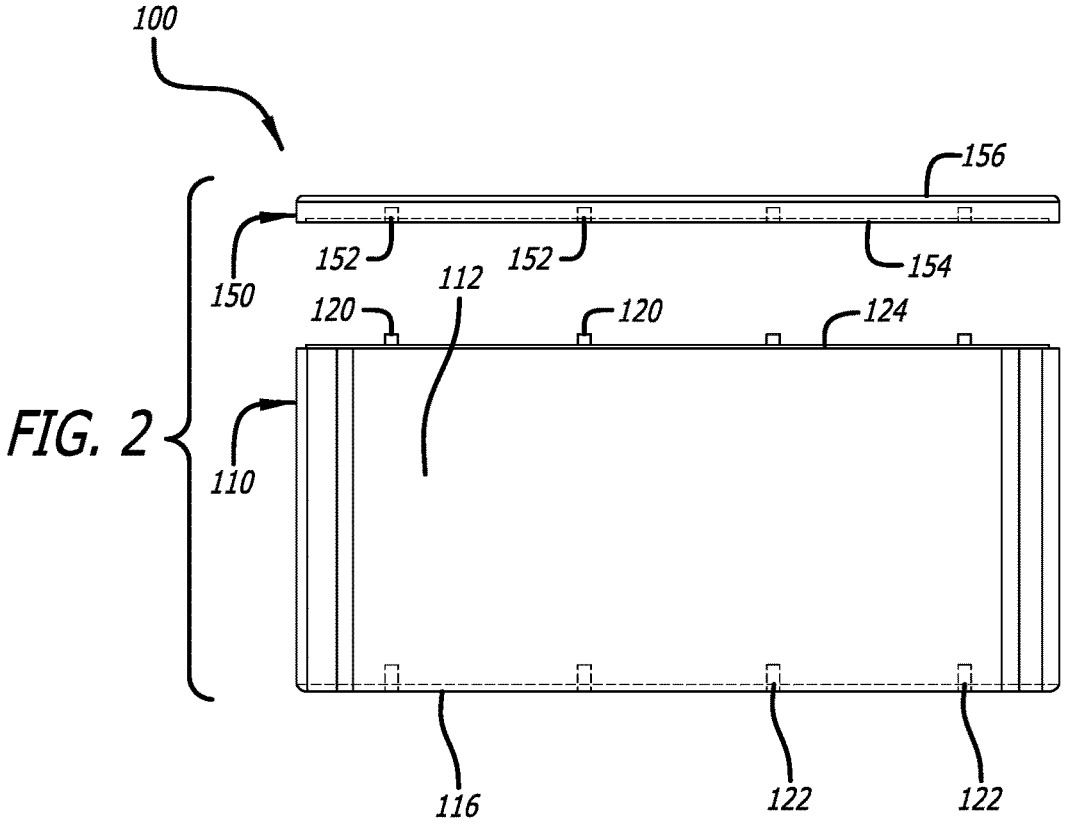
FIG. 2 shows a side view of the construction block and the lid of FIG. 1.
Figure 3:
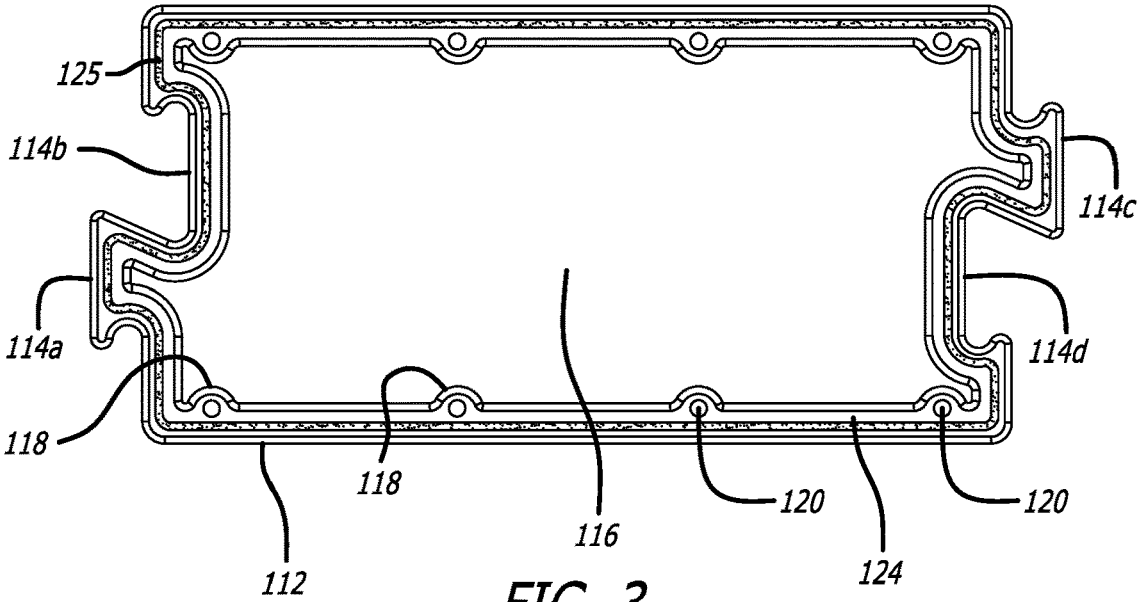
FIG. 3 is a top view of the construction block of FIG. 1.

FIG. 1, FIG. 2, and FIG. 3 show a construction block unit 100 having a substantially rectangular prism shape with an interlocking portion 114*a*, 114*b* at one end and another interlocking portion 114*c*, 114*d* at an opposite end. The construction block unit 100 includes a construction block 110 and a lid 150.

The construction block 110 can have any suitable size and dimensions for use in construction of structures. For example, the width of the construction block 110 can be in a range from 4 inches to 24 inches. A typical width of the construction block 110 can be in a range from 6 inches to 12 inches, such as 8 inches. Exemplary lengths of the construction block 110 can be in a range from 4 inches to 36 inches. A typical width of the construction block 110 can be in a range from 10 inches to 24 inches, such as 16 inches.

The construction block 110 has a substantially vertical sidewall 112 extending from an outer edge of a substantially planar bottom plate 116. The vertical sidewall 112 can be any suitable height for use in construction. For example, the vertical sidewall 112 can have a height in a range from 3 inches to 48 inches. Typical vertical sidewall 112 heights can be in a range from 6 inches to 24 inches, such as 8 inches. A thickness of the vertical sidewall 112 can be based on the material from which the sidewall is constructed. The thickness can be a suitable thickness to support the weight of materials used for weighting the construction block 110, such as sand or water, and support weight of additional materials positioned on top such as additional construction blocks and roofing material. For example, the thickness can be in a range from 0.4 inches to 1.5 inches. A typical thickness can be in a range from 0.5 inches to 0.9 inches, such as 0.6 inches.

The bottom plate 116 has a shape corresponding to a bottom edge of the sidewall 112. The sidewall 112 connects to the bottom plate 116 to enclose an open space container 117 in the interior of the construction block 110, which is suitable for receiving and containing a weight. The sidewall 112 and the bottom plate 116 can be formed at the same time as one continuous piece. Alternatively, the sidewall 112 and the bottom plate 116 can be formed separately and then joined by any suitable means, such as an adhesive or melting contacting pieces together. A thickness of the bottom plate 116 can be any suitable thickness, and can be the same or different from the sidewall 112 thickness.

An interlocking portion including a tab 114*a* and a blank 114*b* are on one side of the construction block 110. The tab 114*a* and the blank 114*b* can be formed by bends and curves in the sidewall 112, and can extend vertically along some or all of the side. The tab 114*a* and the blank 114*b* are configured to interlock with a corresponding blank and tab of another construction block. For example, when viewed from above, one or more sections of a top of the sidewall appear to bend to form tabs, while one or more other sections can bend to form blanks, much like a puzzle piece. In the example shown in FIG. 2, the tab 114*a* broadens as the tab 114*a* extends towards the exterior, and the blank 114*b* broadens as the blank 114*b* extends towards the interior.

To interlock the construction blocks 110 to construct a wall, a first construction block can be held above and aligned with a second construction block such that when the first construction block is lowered into place, the tab of the first construction block slides into the blank of the second construction block and the tab of the second construction block slides into the blank of the first construction block to interlock the sidewalls of the first construction block and the second construction block. For example, the corresponding blank and tab of another construction block can slide vertically into the tab and blank such that the construction blocks are interlocked. Horizontal forces are prevented from pulling the construction blocks apart when the construction blocks are interlocked. The construction blocks can be separated again by sliding one vertically with respect to the other.

The construction block 110 can have another interlocking portion including a tab 114*c* and a blank 114*d* on an opposite side of the construction block 110. Thus, the construction block 110 can be interlocked with other construction blocks on both sides. Many construction blocks can be interlocked to create a horizontal layer of a structure.

The sidewall 112 can be shaped to have either sharp corners or rounded corners, or may have some corners that are sharp while others are rounded.

The construction block 110 can include strengthening structural ribs 118 disposed on the walls at suitable intervals. In one example shown in FIG. 2 and FIG. 3, the structural ribs 118 can extend vertically along an interior surface of the sidewall 112. The structural ribs 118 can have any suitable thickness for providing an increase in structural strength of the sidewall 112 and the construction block 110 to increase the weight that can be supported. For example, the structural rib 118 can have a thickness of in a range from 0.2 inches to 1 inches, such 0.245 inches.

The construction block 110 can further include fasteners 120 for coupling the construction block to either a lid 150 or another construction block. The fasteners 120 can be located at ends of the structural ribs 118 that extend beyond a top edge 124 of the sidewall 112. For example, the fasteners 120 can be cylindrical, like pegs, or can have several sides, such as three, four, or six sides. The fasteners 120 can have any suitable dimensions for coupling the construction block. For example, the fastener 120 can have a height in a range from 0.2 inches to 1 inch, such as 0.320 inches, and can have a thickness in a range from 0.2 inches to 0.5 inches, such as 0.245 inches.

The fasteners 120 can be received by a corresponding element of another construction block, such as an opening 122 on a bottom surface of the bottom plate 116. For example, the fasteners 120 can be received by the opening 122 with a friction fit. Thus, the dimensions of the opening 122 are dimensions that are suitable for receiving the fastener 120 with a friction fit. The construction block 110 may further be fastened to another construction block with adhesive, which can also be applied to the fasteners 120 and/or openings 152 In this way, the construction block 110 can be fastened to the top of another construction block. The top construction serves as a cover for the container 117 of the construction block positioned below to contain any weight in the container 117 and prevent any other materials from being placed in the lower construction block.

The number of fasteners 120 and corresponding opening 122 can be any suitable number for fastening one construction block to another. For example, the number of fasteners 120 and corresponding openings 122 and be in a range from 3 to 20. In FIGS. 1, 2, and 3, 8 fasteners 120 are shown.

The lid 150 has a congruent shape to the bottom plate 116 and is configured to close the open space container 117 in the interior of the construction block 110. The lid 150 can have any suitable thickness to close the container 117, which may be the same or different from the thicknesses of the sidewalls 112 and the bottom plate 116. For example, the lid 150 can have a thickness of 0.6 inches.

The lid 150 has openings 152 positioned to correspond to and receive the fasteners 120 such that the lid 150 is fastenable to the construction block 110, for example, with a friction fit. The dimensions of the openings 152 are dimensions that are suitable for receiving the fastener 120 with a friction fit. In this way, the lid 150 can be fastened to the construction block 110. The lid 150 may further be fastened to the construction block 110 with adhesive, which can also be applied to the fasteners 120 and/or openings 152 For example, the lids can be fastened to construction blocks at the top of a wall being constructed. The lids can contain any weight in the container 117 and prevent any other materials from being placed in the lower construction block.

The construction block 110 and the lid 150 can be constructed of the same or different materials. For example, the construction block 110 and the lid 150 can be formed of plastics, polymers, composite materials, fiberglass, metal, foam, and recycled materials.

The container 117 can be filled with any suitable material to add weight to the construction block and stability to the structure, including, but not limited to, water, sand, concrete, dirt, rocks, and gravel.

A seal 125 can be positioned at the top edge 124 of the sidewall 122. The seal 125 seals the construction block 110 to either another construction block positioned above it or a lid 150 to further contain any weight in the container 117 and prevent any other materials from being placed in the container 117. The seal 125 can be any suitable material, such as foam, rubber, polymers, plastic, silicone, and wax. The seal 125 may also have an adhesive to adhere the seal 125 to construction block and/or the seal. The seal 125 can have any suitable thickness for sealing a lid or a construction block to another construction block. For example, the seal can have a thickness in a range from 0.05 inches to 0.3 inches, such as 0.1 inches.

The construction blocks can include other features that allow the construction blocks to be used with other building materials. For example, the construction blocks can have surfaces that are appropriately textured for painting or application of siding, stucco, adhesive, insulation, drywall, or plaster. The construction blocks may also be able to receive coupling devices, such as tacks, nails, or screws, so that other types of construction materials can be fastened to the construction blocks.

The construction blocks can be various shapes and sizes such that various different structures can be assembled from the blocks. The different construction blocks can include different shapes so that walls can be constructed at various angles. Construction blocks can also have shapes that allow for door and window openings. The construction blocks can be used to construct exterior and interior walls.

Figure 4:
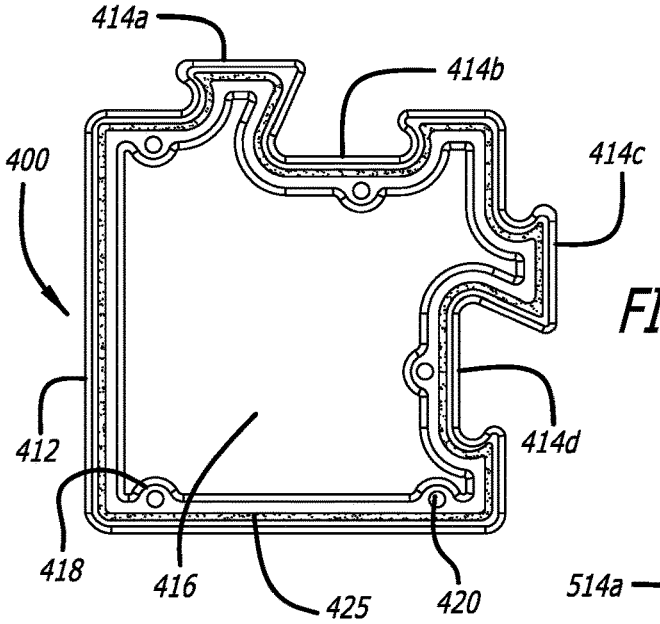
FIG. 4 is a top view of a corner construction block.

FIG. 4 is a top view of a corner construction block 400, which includes a sidewall 412, a bottom plate 416, structural ribs 418, fasteners 420, and a seal 425, as similarly described above. The corner construction block 400 has a first interlocking portion with a tab 414*a* and a blank 414*b*, and a second interlocking portion with a tab 414*c* and a blank 414*d*. The corner construction block 400 can be used at corners of structure walls to connect one wall with another wall at a right angle. A receptacle of corner construction block 400 can also be with a lid with a congruent shape.

Figure 5:
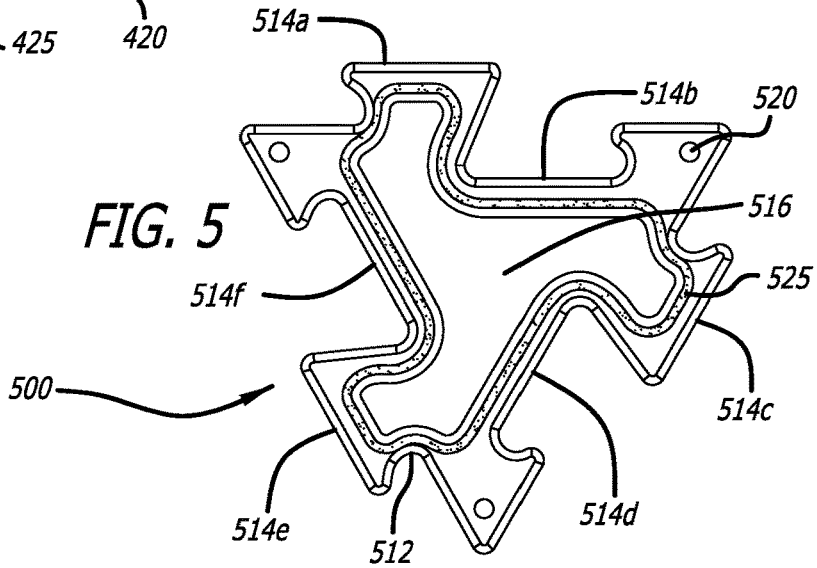
FIG. 5 is a top view of a three-sided construction block.

FIG. 5 is a top view of a three-sided construction block 500, which includes a sidewall 512, a bottom plate 516, fasteners 520, and a seal 525, as similarly described above. The three-sided construction block has a first interlocking portion with a tab 514*a* and a blank 514*b*, a second interlocking portion with a tab 514*c* and a blank 514*d*, and a third interlocking portion with a tab 514*e* and a blank 514*f*. The three-sided construction block 500 can be used to join structure walls at angles of 120 degrees and 240 degrees. A receptacle of three-sided construction block 500 can also be closed with a lid with a congruent shape.

Figure 6:
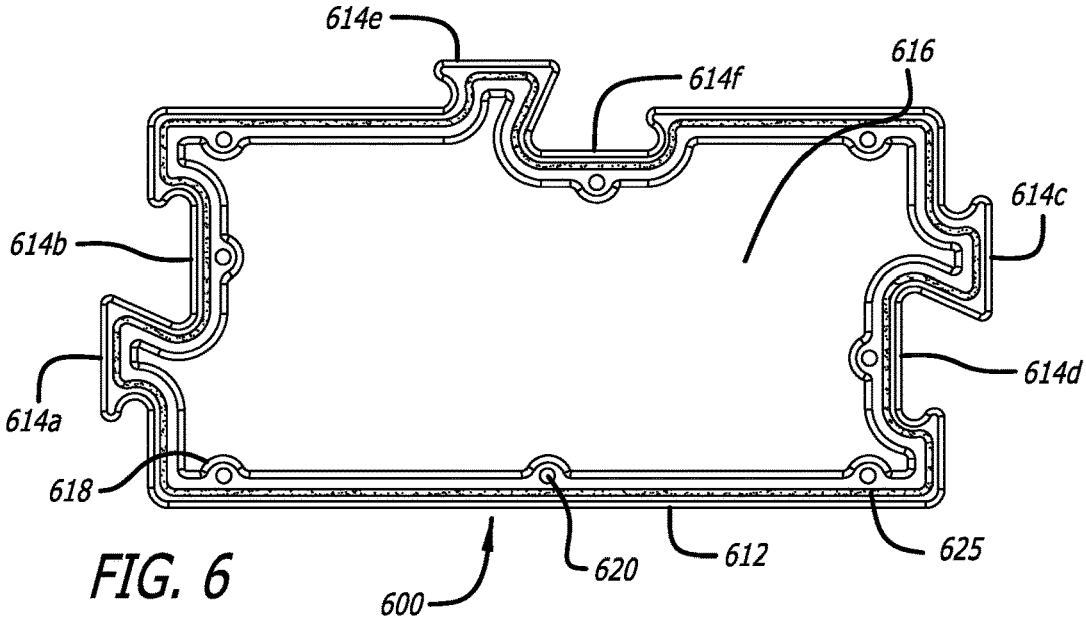
FIG. 6 is a top view of a "T" construction block.

FIG. 6 is a top view of a "T" construction block 600, which includes a sidewall 612, a bottom plate 616, structural ribs 618, fasteners 620, and a seal 625, as similarly described above. The "T" construction block has a first interlocking portion with a tab 614*a* and a blank 614*b*, a second interlocking portion with a tab 614*c* and a blank 614*d*, and a third interlocking portion with a tab 614*e* and a blank 614*f*. The "T" construction block 600 is similar to construction block 100 of FIG. 1, but has the additional third interlocking portion on a wall adjacent to the first interlocking portion. The "T" construction block 600 can be used to construct a "T" shaped structure where one wall intersects with another wall. A receptacle of "T" construction block 600 can also be closed with a lid with a congruent shape.

Figure 7:
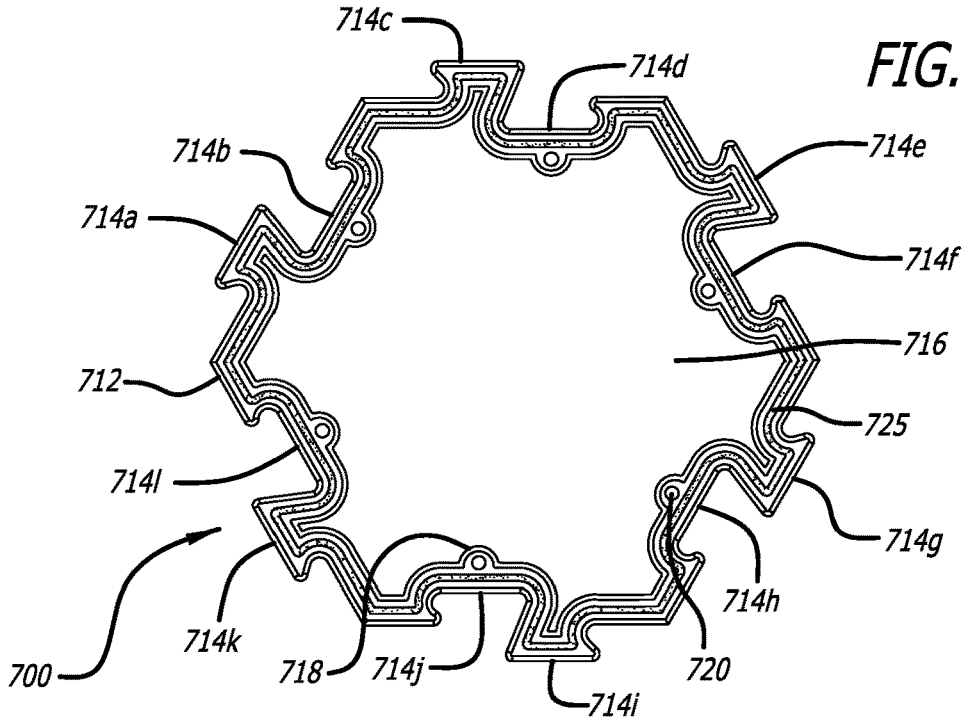
FIG. 7 is a top view of a six-sided construction block.

FIG. 7 is a top view of a six-sided construction block 700, which includes a sidewall 712, a bottom plate 716, structural ribs 718, fasteners 720, and a seal 725, as similarly described above. The six-sided construction block 700 has a first interlocking portion with a tab 714*a* and a blank 714*b*, a second interlocking portion with a tab 714*c* and a blank 714*d*, a third interlocking portion with a tab 714*e* and a blank 714*f*, a fourth interlocking portion with a tab 714*g* and a blank 714*h*, a fifth interlocking portion with a tab 714*i* and a blank 714*j*, and a sixth interlocking portion with a tab 714*k* and a blank 714*l*. The six-sided construction block 700 can be used to join structure walls at angles of 60 degrees, 120 degrees, 180 degrees, 240, degrees, and 300 degrees. A receptacle of six-sided construction block 700 can also be closed with a lid with a congruent shape.

Figure 8:
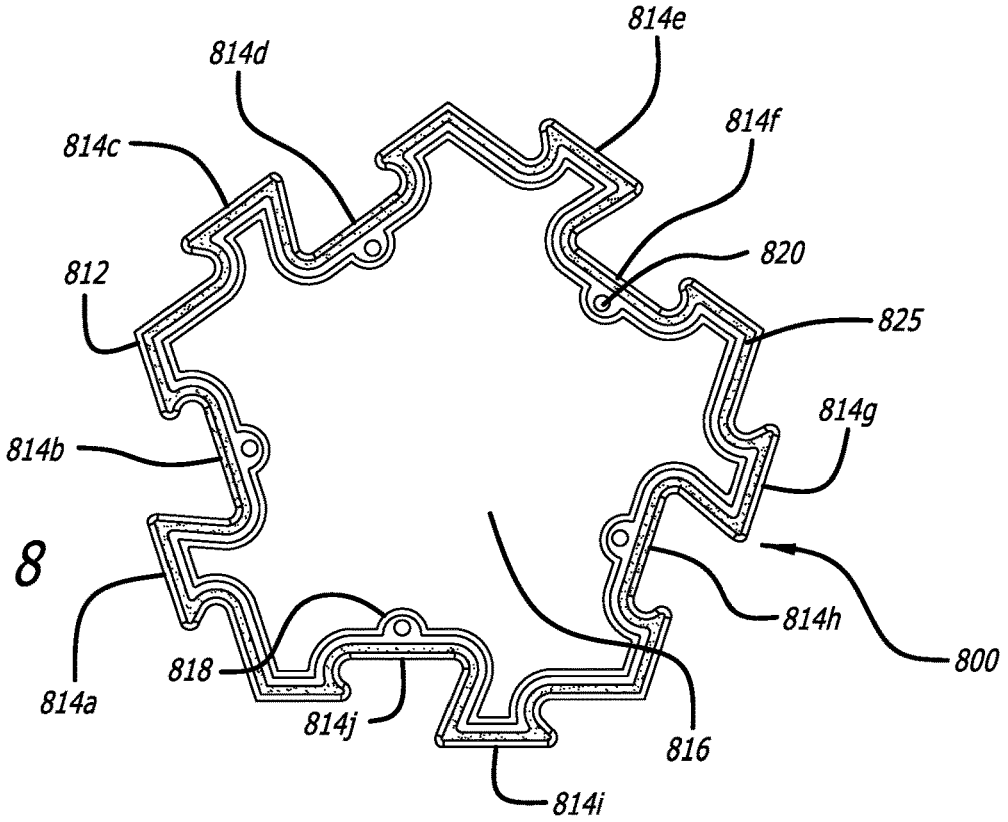
FIG. 8 is a top view of a five-sided construction block.

FIG. 8 is a top view of a five-sided construction block 800, which includes a sidewall 812, a bottom plate 816, structural ribs 818, fasteners 820, and a seal 825, as similarly described above. The five-sided construction block 800 has a first interlocking portion with a tab 818*a* and a blank 814*b*, a second interlocking portion with a tab 814*c* and a blank 814*d*, a third interlocking portion with a tab 814*e* and a blank 814*f*, a fourth interlocking portion with a tab 814*g* and a blank 814*h*, and a fifth interlocking portion with a tab 814*i* and a blank 814*j*. The five-sided construction block 800 can be used to join structure walls at angles of 72 degrees, 144 degrees, 216 degrees, and 288 degrees. A receptacle of five-sided construction block 800 can also be closed with a lid with a congruent shape.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A construction block unit comprising:

a construction block comprising:

a bottom plate having a shape; and a sidewall extending perpendicularly from the bottom plate at an outer edge of the bottom plate to form a container configured to receive and contain a weight;

a lid having a congruent shape to the shape such that the lid is fastenable to a top edge of the side wall to enclose the receptacle; and a seal between the construction block and the lid configured to seal the lid to the construction block, wherein an interlocking portion of the construction block is shaped to receive a corresponding interlocking portion of a second construction block by vertically sliding the corresponding interlocking portion into the interlocking portion, wherein the the construction block and the second construction block are configured to interlock to prevent separation by a horizontal force.

2. The construction block unit of claim 1, wherein the construction block further comprises at least one structural support rib extending along the sidewall perpendicularly to the bottom plate.

3. The construction block unit of claim 1, further comprising a plurality of fasteners coupled to the top edge of the sidewall opposite the bottom plate and configured to fasten the lid to the construction block.

4. The construction block unit of claim 3, wherein the lid comprises a plurality of openings each shaped and positioned to receive a respective one of the plurality of fasteners.

5. The construction block unit of claim 4, wherein the at least one opening receives the at least one fastener with a friction fit to couple the lid to the construction block.

6. The construction block unit of claim 3, wherein the bottom plate comprises a plurality of openings on a surface opposite the sidewall, each shaped and positioned to receive a respective one of the plurality of fasteners of a third construction block.

7. The construction block unit of claim 1, wherein the container is configured to contain a liquid weight.

8. The construction block unit of claim 1, wherein a second interlocking portion of the construction block is shaped to receive a second corresponding interlocking portion of a third construction block.

9. The construction block unit of claim 8, wherein a third interlocking portion of the construction block is shaped to receive a third corresponding interlocking portion of a fourth construction block.

10. The construction block unit of claim 1, wherein the construction block is configured to couple to a third construction block positioned below the construction block.

11. The construction block unit of claim 1, wherein the interlocking portion comprises a first tab and a first blank; and wherein the corresponding interlocking portion comprises a second blank configured to receive the first tab and a second tab configured to be received by the first blank.

12. The construction block unit of claim 1, wherein the shape is substantially triangular with the interlocking portion on one side of the shape, and wherein the construction block further comprises a second interlocking portion on an adjacent side of the shape.

13. The construction block unit of claim 1, wherein the shape is substantially rectangular with the interlocking portion on one side of the shape, and wherein the construction block further comprises a second interlocking portion on an opposite side of the shape.

14. The construction block unit of claim 13, wherein the construction block further comprises a third interlocking portion on an adjacent side of the shape.

15. The construction block unit of claim 1, wherein the shape is substantially pentagonal with the interlocking portion on one side of the shape, and wherein the construction block further comprises a second interlocking portion on an adjacent side of the shape.

16. The construction block unit of claim 1, wherein the shape is substantially hexagonal with the interlocking portion on one side of the shape, and wherein the construction block further comprises a second interlocking portion on an adjacent side of the shape.

17. A construction block system comprising:

a first construction block unit comprising:

a first construction block comprising:

a first bottom plate having a first shape;

a first sidewall extending perpendicularly from the first bottom plate at an outer edge of the first bottom plate to form a first container configured to receive and contain a weight; and a plurality of first fasteners coupled to a first top edge of the first sidewall opposite the first bottom plate;

a first lid having a congruent shape to the first shape such that the first lid is fastenable to the first top edge of the first sidewall via the plurality of first fasteners to enclose the first container; and a first seal between the first construction block and the first lid configured to seal the first lid to the first construction block; and a second construction block unit comprising:

a second construction block comprising:

a second bottom plate having a second shape;

a second sidewall extending perpendicularly from the second bottom plate at an outer edge of the second bottom plate to form a second container configured to receive and contain another weight; and a plurality of second fasteners coupled to a second top edge of the second sidewall opposite the second bottom plate;

a second lid having a congruent shape to the second shape such that the second lid is fastenable to the second top edge of the second sidewall via the plurality of second fasteners to enclose the second container; and a second seal between the second construction block and the second lid configured to seal the second lid to the second construction block, wherein an interlocking portion of the first construction block is shaped to receive a corresponding interlocking portion of the second construction block by vertically sliding the corresponding interlocking portion into the interlocking portion, wherein the the first construction block and the second construction block are configured to interlock to prevent separation by a horizontal force.

18. The construction block system of claim 17, wherein the second shape is different from the first shape.

19. The construction block system of claim 17, wherein the interlocking portion and the corresponding interlocking portion are configured to couple the first construction block to the second construction block at an angle.

20. The construction block system of claim 17, wherein the first construction block is configured to couple to a third construction block positioned below the first construction block.

* * * * *